US010400321B1

(12) United States Patent
Zheng

(10) Patent No.: US 10,400,321 B1
(45) Date of Patent: Sep. 3, 2019

(54) PREPARATION OF NANOSTRUCTURED TITANIUM

(71) Applicant: THE HONG KONG POLYTECHNIC UNIVERSITY, Hong Kong (CN)

(72) Inventor: Guangping Zheng, Hong Kong (CN)

(73) Assignee: THE HONG KONG POLYTECHNIC UNIVERSITY, Hong Kong (HK)

( * ) Notice: Subject to any disclaimer, the term of this patent is extended or adjusted under 35 U.S.C. 154(b) by 0 days.

(21) Appl. No.: 16/439,757

(22) Filed: Jun. 13, 2019

Related U.S. Application Data

(62) Division of application No. 15/219,280, filed on Jul. 26, 2016.

(60) Provisional application No. 62/249,945, filed on Nov. 3, 2015.

(51) Int. Cl.
*C22F 1/18* (2006.01)
*B21B 3/00* (2006.01)

(52) U.S. Cl.
CPC ..... *C22F 1/183* (2013.01); *B21B 3/00* (2013.01)

(58) Field of Classification Search
CPC ..... C22C 14/00; C22F 1/183
See application file for complete search history.

(56) References Cited

PUBLICATIONS

Zherebtsov, S. V., et al. "Formation of nanostructures in commercial-purity titanium via cryorolling." Acta materialia 61.4 (2013): 1167-1178.*

* cited by examiner

*Primary Examiner* — Jessee R Roe
(74) *Attorney, Agent, or Firm* — Spruson & Ferguson (Hong Kong) Limited

(57) ABSTRACT

The present disclosure relates to the preparation of bulk nanostructured pure titanium at cryogenic temperatures using rolling, allowing the whole microstructures of pure titanium to be refined into the one that the mean grain size is smaller than 100 nm.

8 Claims, 7 Drawing Sheets

TEM bright field images

PREPARATION OF NANOSTRUCTURED TITANIUM

CROSS REFERENCE TO RELATED APPLICATION

This application is a continuation of U.S. non-provisional patent application Ser. No. 15/219,280 filed Jul. 26, 2016, which claims benefit of U.S. provisional patent application Ser. No. 62/249,945 filed Nov. 3, 2015. The foregoing applications are incorporated by reference in their entirety as if fully set forth herein.

TECHNICAL FIELD

The present disclosure relates to a nanostructured pure titanium, more particularly, the present invention relates to a method for preparing a bulk nanostructured pure titanium.

BACKGROUND

It is a long-standing issue that medical implants made of metallic materials such as titanium (Ti) alloys and steels suffer unsatisfactory corrosion resistance and mechanical strength, and service life time much less than 10 years. Although pure titanium (wt. %>99%) or less alloyed titanium has relatively low mechanical strength (<350 MPa) and unsatisfactory fatigue behavior compared to those of titanium alloys, its in vivo and in vitro biocompatibility has been well proven to be unparallel by any titanium alloys and most other metals and alloys (such as steels) used for medical applications. Titanium with ultra-fine microstructure has been proved to have much improved mechanical strength and fatigue resistance than those of coarse-grained titanium. Besides, a lot of medical trials suggest that ultra-fine-grained (UFG) Ti has improved biocompatibility. It is generally believed that nanostructured Ti with a mean grain size below 100 nm is more preferable for medical implant applications.

There are critical outstanding issues that have hindered the nanostructured Ti with outstanding mechanical properties and biocompatibility to be synthesized, and its subsequent development for structural and medical applications. The most important one is how to effectively prepare bulk titanium with dense nanostructures in a consistent and reliable manner. The currently known technique to prepare bulk nanostructured Ti is severe plastic deformation (SPD), which has two major limitations: (1) most of the grains of these nanostructured Ti have their sizes typically in the UFG regime (~100-1000 nm), i.e., beyond the strongest size regime (tens of nanometers) of nanostructured metals; (2) the as-prepared UFG-Ti or nanostructured Ti has low ductility (elongation to failure <10%). Therefore, how to prepare bulk nanocrystalline Ti with grain sizes less than ~100 nm and large ductility is a current challenge.

Current SPD technology cannot effectively prepare bulk pure titanium with a mean grain size smaller than 100 nm at room temperatures or elevated temperatures.

Although there are attempts in using bulk pure titanium with nanostructured surfaces manufactured by laser sintering, surface mechanical attrition treatment or plasma etching, the reliability and the resistances to corrosion and fatigue of these surface nanostructured titanium under the complex human body fluid conditions are questionable. Bulk nanostructured pure titanium not only could have enhanced mechanical strength and biocompatibility, but also could have better corrosion and fatigue resistances simply because they have much less impurities as compared with those of titanium alloys or steels.

There is a need in the art to have methods for fabricating a bulk nanostructured pure titanium with a mean grain size smaller than 100 nm.

SUMMARY

Provided herein is a method for preparing a bulk nanostructured pure titanium from a pure titanium plate comprising: providing at least one roller; injecting liquid nitrogen onto the pure titanium plate to cool down the pure titanium plate to a temperature between −125° C. and −50° C.; and rolling the cooled pure titanium plate by the at least one roller to form the bulk nanostructured pure titanium.

In certain embodiments, the at least one roller includes two rollers respectively located on both sides of the pure titanium plate.

In certain embodiments, the step of rolling has a rolling speed between 0.05 and 2 rad/min.

In certain embodiments, the cooled pure titanium plate is rolled 15 to 30 times.

In certain embodiments, the pure titanium plate has a thickness between 2 mm and 10 mm.

In certain embodiments, the bulk nanostructured pure titanium comprises grain sizes of less than 100 nm.

In certain embodiments, the liquid nitrogen is injected from at least one liquid nitrogen sprayer.

In certain embodiments, the at least one liquid nitrogen sprayer includes two liquid nitrogen sprayers respectively located on both sides of one of the at least one roller.

The method described above is able to provide a bulk nanostructured pure titanium with a mean grain size smaller than 100 nm, and said bulk nanostructured pure titanium possesses enhanced in vivo and in vitro biocompatibility, mechanical strength and ductility.

BRIEF DESCRIPTION OF DRAWINGS

Embodiments of the present invention are described in more detail hereinafter with reference to the drawings, in which.

DETAILED DESCRIPTION

In the following description, a bulk nanostructured pure titanium and the corresponding fabrication methods are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

The present invention relates to the preparation of bulk nanostructured pure titanium at cryogenic temperatures using equal channel angular pressing and rolling, allowing the whole microstructures of pure titanium to be refined into the one that the mean grain size is smaller than 100 nm.

Figure 1:
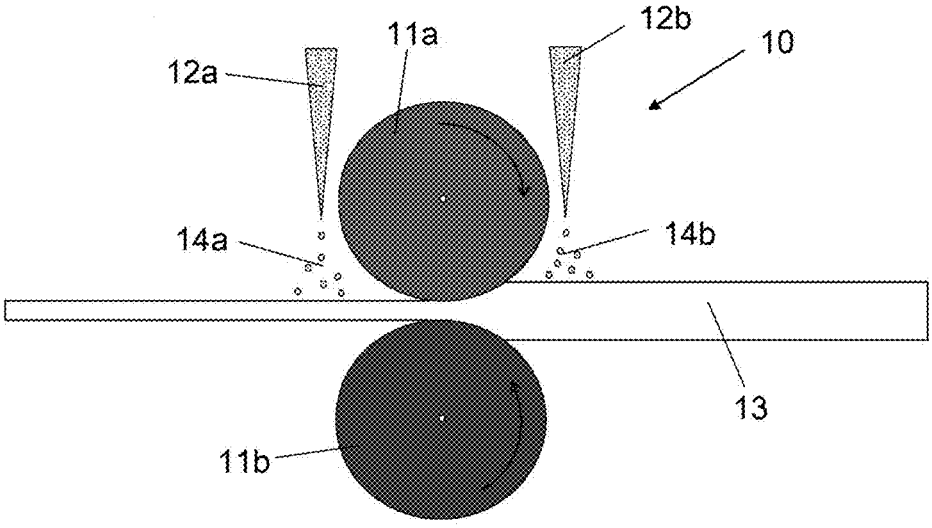
FIG. 1 shows a schematic diagram of rolling a pure titanium plate according to an embodiment of the presently claimed invention.

FIG. 1 shows a schematic diagram of rolling a pure titanium plate according to an embodiment of the presently claimed invention. The cryogenic rolling system 10 comprises two rollers 11*a*, 11*b*, and two liquid nitrogen ($LN_2$) nozzles 12*a*, 12*b*. The $LN_2$ nozzles 12*a*, 12*b*, located at both sides of the roller 11*a*, eject $LN_2$ flows 14*a*, 14*b* towards a Ti plate 13 for cooling down the Ti plate 13 to a cryogenic temperature. The pure Ti plate 13 is cooled down to −125--50° C. by the $LN_2$ flows 14*a*, 14*b* before being rolled by the two rollers 11*a*, 11*b* to form bulk nanostructured pure titanium.

The temperature of the pure titanium plates is controlled by the flow speed of $LN_2$. Preferably, the thickness of the pure titanium plates is 2-5 mm, the rolling speed is 0.05-2 rad/min, and the rolling is carried out for 15-30 times at a percentage of reduction on thickness.

Figure 2:
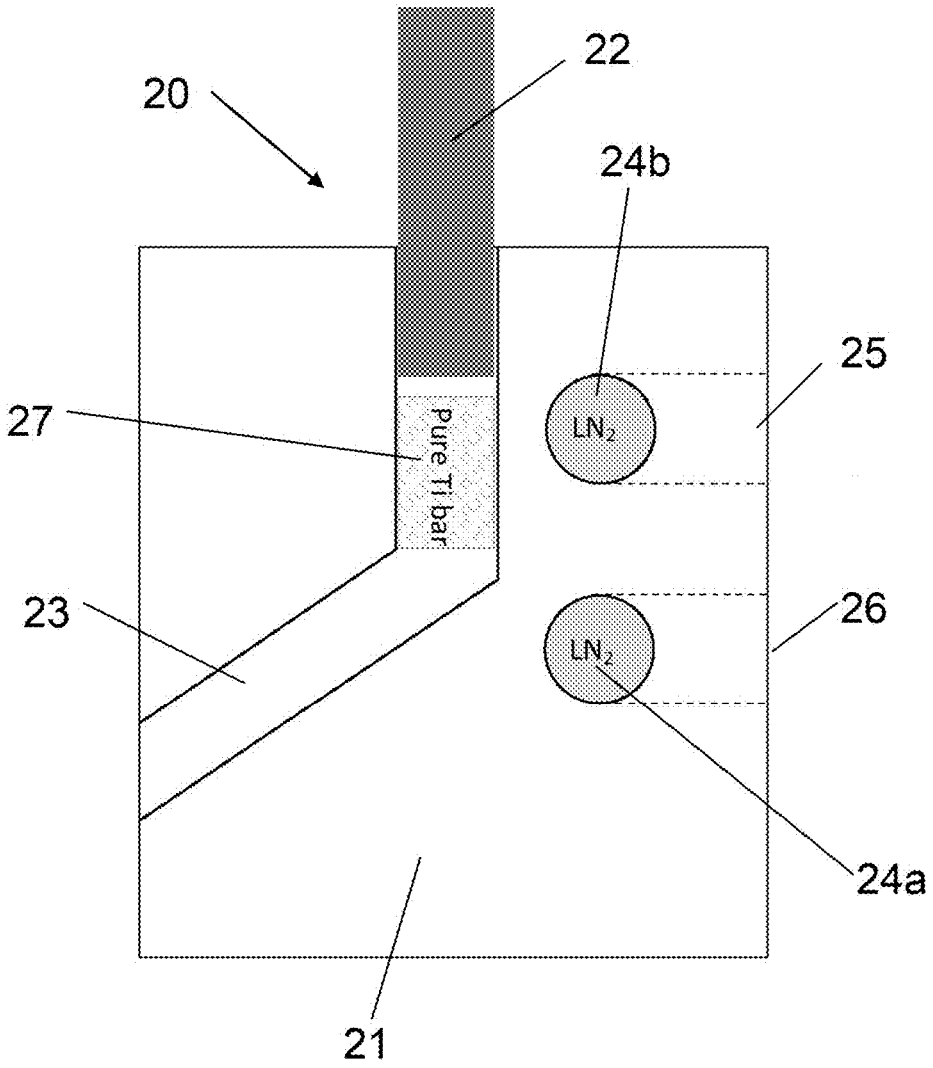
FIG. 2 shows a cross section diagram of a die with built-in channels for liquid nitrogen flow used in equal channel angular pressing according to an embodiment of the presently claimed invention.

FIG. 2 shows a schematic diagram of a die with built-in channels for liquid nitrogen flow used in equal channel angular pressing according to an embodiment of the presently claimed invention. A cryogenic ECAP system 20 comprises an ECAP die 21 and a punch pin 22. The ECAP die 21 comprises an angular channel 23, $LN_2$ channels 24*a*, 24*b*, and a $LN_2$ inlet 25 and a $LN_2$ outlet 26. The angular channel 23 is bent through an angle of 120 degree. A liquid nitrogen flow is injected into the $LN_2$ channels 24*a*, 24*b* through the $LN_2$ inlet 25 for cooling down the ECAP die 21, and then is released from the ECAP die 21 through the $LN_2$ outlet 26. A pure Ti bar 27 is inserted into the angular channel 23, cooled down to −75--50° C. by the cooled ECAP die 21, and further pressed within the angular channel 23 by the punch pin 22 under cooling of the ECAP die 21 for forming a bulk nanostructured pure Ti bar.

The temperature of the pure titanium plates is controlled by the flow speed of $LN_2$. Preferably, the diameter of pure titanium bar is 10-15 mm, the pressing speed is 4-10 mm/min, and the pressing is carried out for 2-3 times.

Figure 3A:
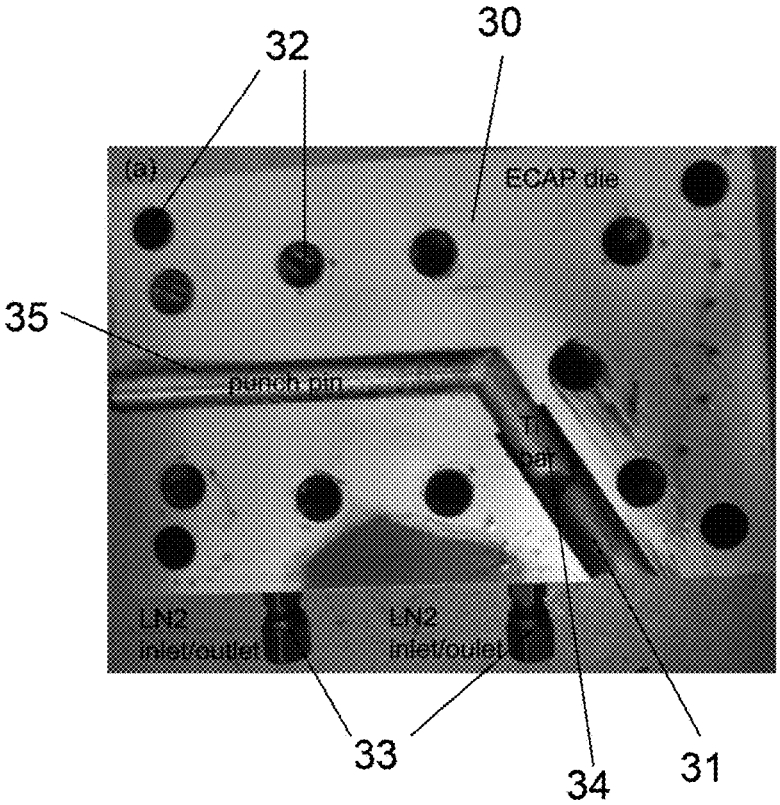
FIG. 3A shows a photo of a cross section of an ECAP die according to an embodiment of the presently claimed invention.
Figure 3B:
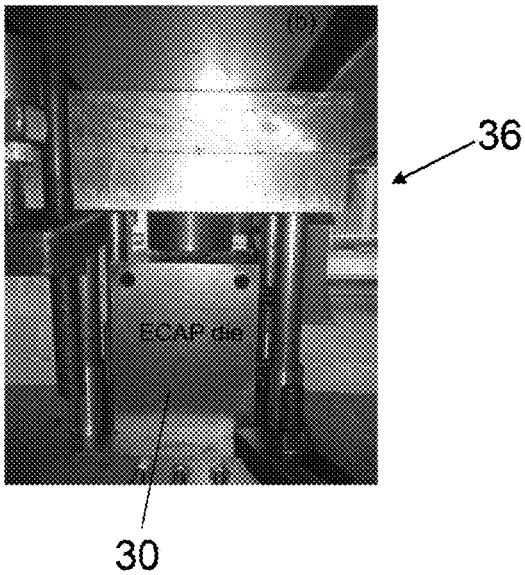
FIG. 3B shows a photo of a cryogenic ECAP system according to an embodiment of the presently claimed invention.

As shown in FIG. 3A, an ECAP die 30 comprises an angular channel 31, a plurality of $LN_2$ channels 32, and $LN_2$ inlet/outlet 33. A pure Ti bar 34 is pressed into the angular channel 31 by a punch pin 35. As shown in FIG. 3B, the ECAP die 30 is installed in an ECAP system 36.

At the room temperature or other elevated temperatures, titanium treated by ECAP usually possesses a mean grain size larger than 100-200 nm. On the contrary, the ECAP processing on titanium at cryogenic temperatures may prevent the small grains from growing into large grains. In addition, the ECAP processing on titanium at cryogenic temperatures could facilitate the deformation twinning, leading to further refinement of grains which have the sizes of several hundreds of nano-meters. Similar results are obtained through the rolling process at cryogenic temperatures. Accordingly, different ranges of cryogenic temperatures are used under the different processing methods that are able to optimize the mechanical properties of the processed titanium.

Figure 4A:
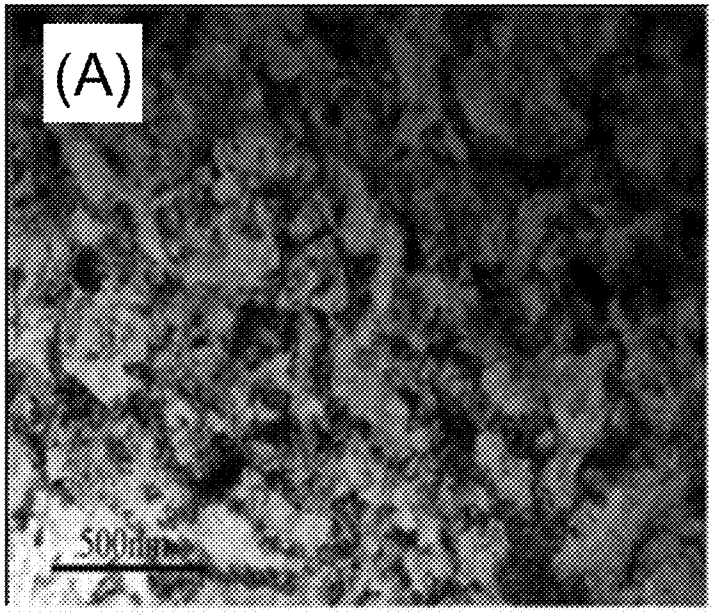
FIG. 4A shows a TEM bright field image of a titanium processed at cryogenic temperature according to an embodiment of the presently claimed invention.
Figure 4B:
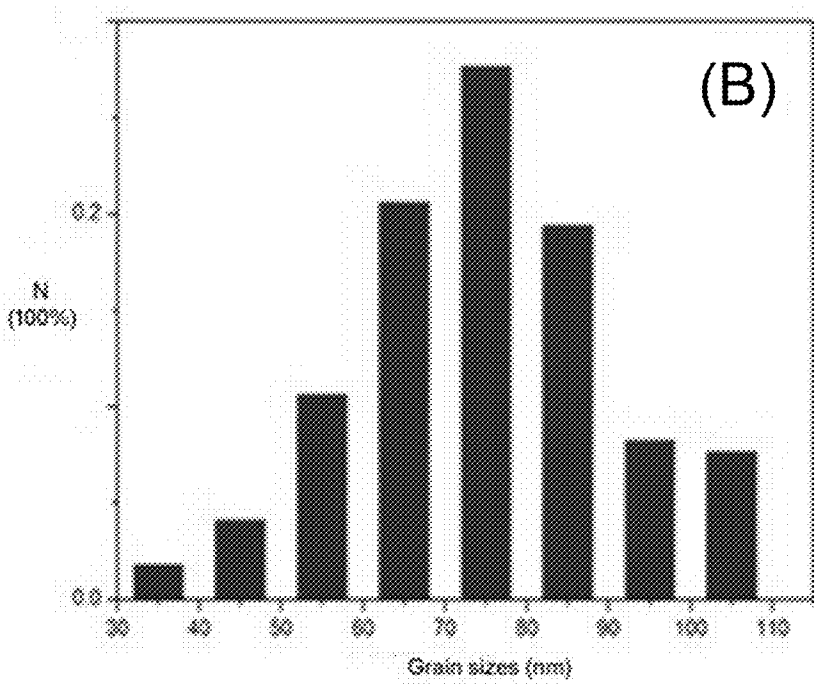
FIG. 4B shows a histogram of counts N on grain sizes according to an embodiment of the presently claimed invention.

FIG. 4A shows a TEM bright field image of a titanium processed at cryogenic temperature. The corresponding processing process was shown as follows. Cryogenic rolling with a percentage reduction on the thickness of Ti plate of 2% was carried out for 15-30 times until the total percentage reduction of its thickness reached 91%. The average of temperatures at the Ti plates before and after rolling was −125° C. The rolling speed is 0.1 rad/min. FIG. 4B shows the corresponding histogram of counts N on grain sizes of the processed titanium. As shown in FIG. 4B, the grain sizes of most of the processed titanium are below 100 nm.

Mechanical testing was preformed in the present invention as mentioned below.

Figure 5:
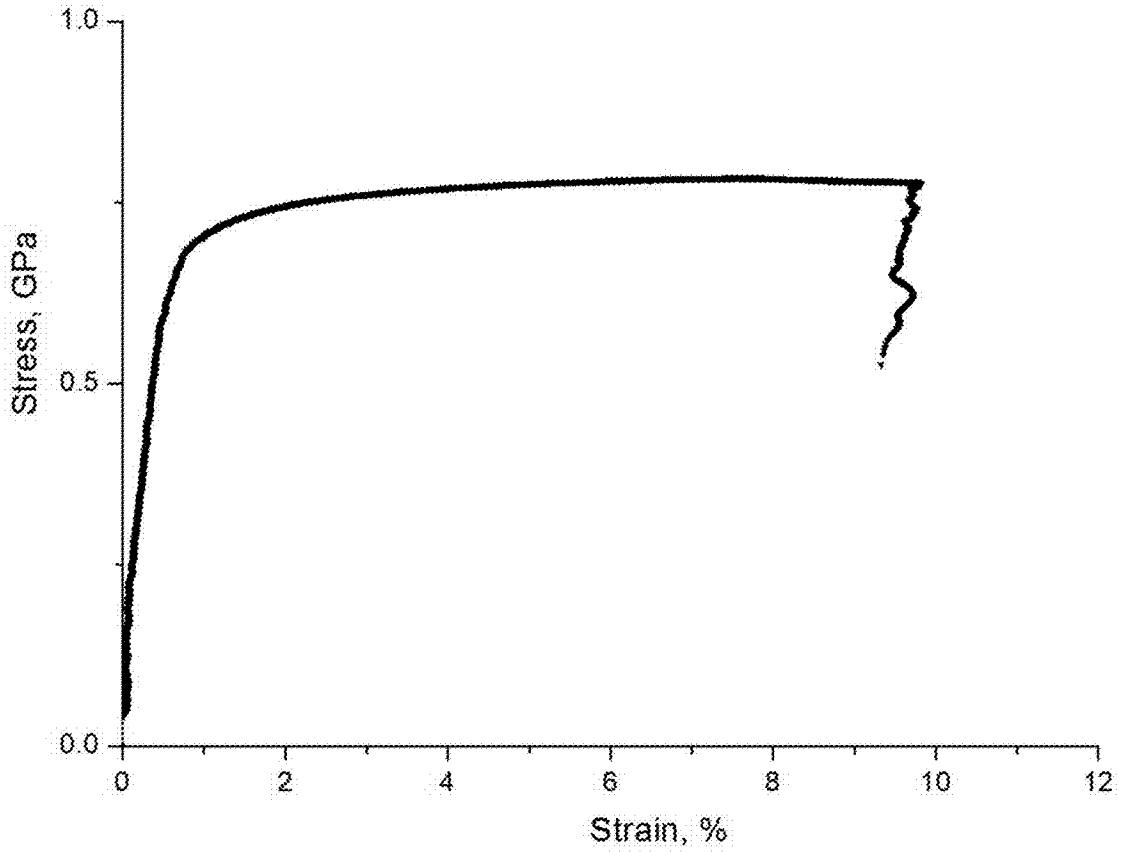
FIG. 5 shows a tensile curve of a titanium plate processed by cryogenic rolling according to an embodiment of the presently claimed invention.

Commercial pure (CP) Ti (grade 2) with a thickness of 2 mm was used as the starting material. The as-received plate was cut into a rectangular shape with a width of 12 mm and a length of 100 mm. The average of temperatures at the Ti plates before and after rolling was −125° C. The rolling speed is 0.1 rad/min. Cryogenic rolling with a percentage reduction on the thickness of Ti plate of 1-2% was carried out for 15-30 times until the total percentage reduction on its thickness reached 91%. The mechanical strength of the processed titanium plate was tested. As shown in the tensile curve of FIG. 5, the processed titanium plate has mechanical strength larger than 750 MPa and ductility larger than 10%.

Figure 6:
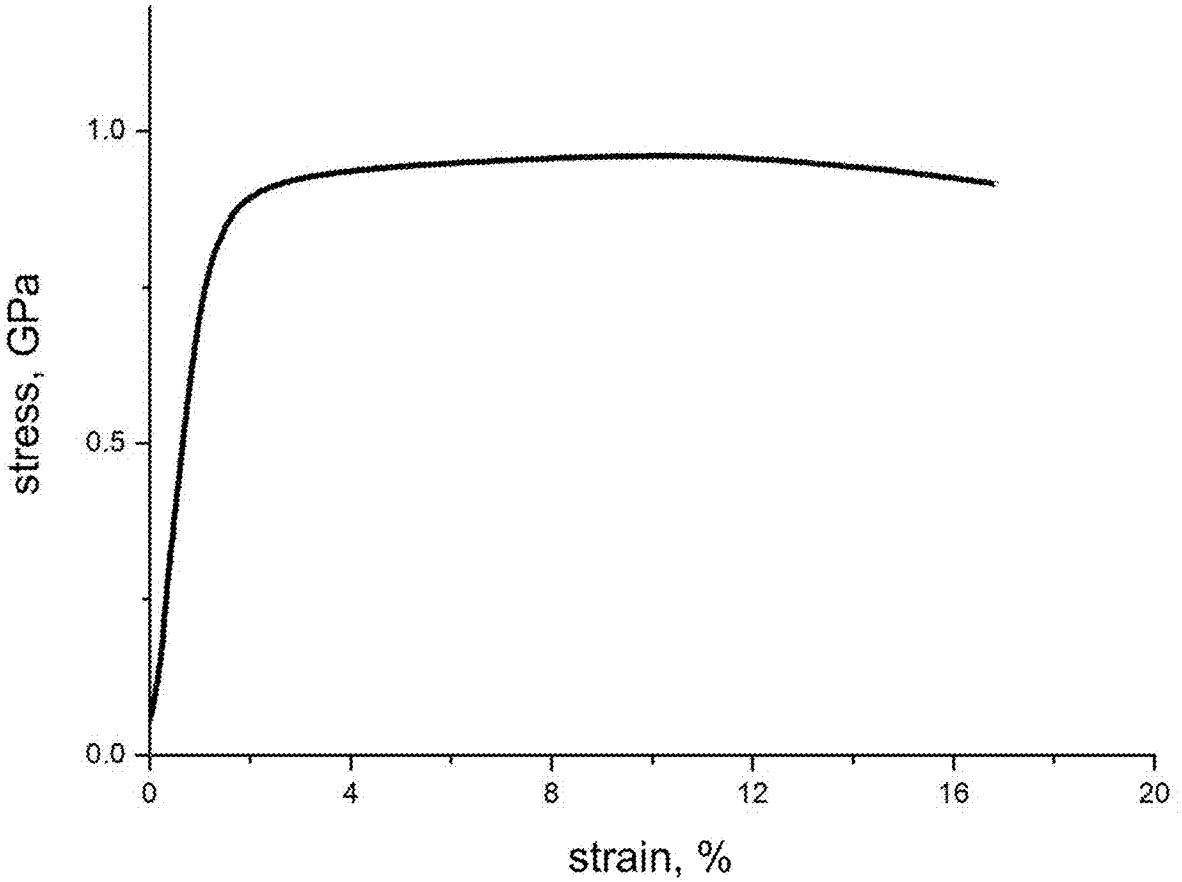
FIG. 6 shows a tensile curve of a titanium bar processed by cryogenic ECAP according to an embodiment of the presently claimed invention.

Commercial pure (CP) Ti (grade 2) was used as the starting material. The Ti bar with a diameter of 15 mm and length of 80 mm was loaded into the ECAP die channel before the die was cooled by the $LN_2$. The ECAP processing was carried out on the Ti bar when the temperature of its top surface reached −75° C. The pressing speed is 4.2 mm/min. The Ti bar was subjected to ECAP processing with route BC for 3 passes. The mechanical strength of the processed titanium bar was tested. As shown in the tensile curve of FIG. 6, the processed titanium bar has mechanical strength in a range of 750-960 MPa and ductility larger than 10%.

Figure 7:
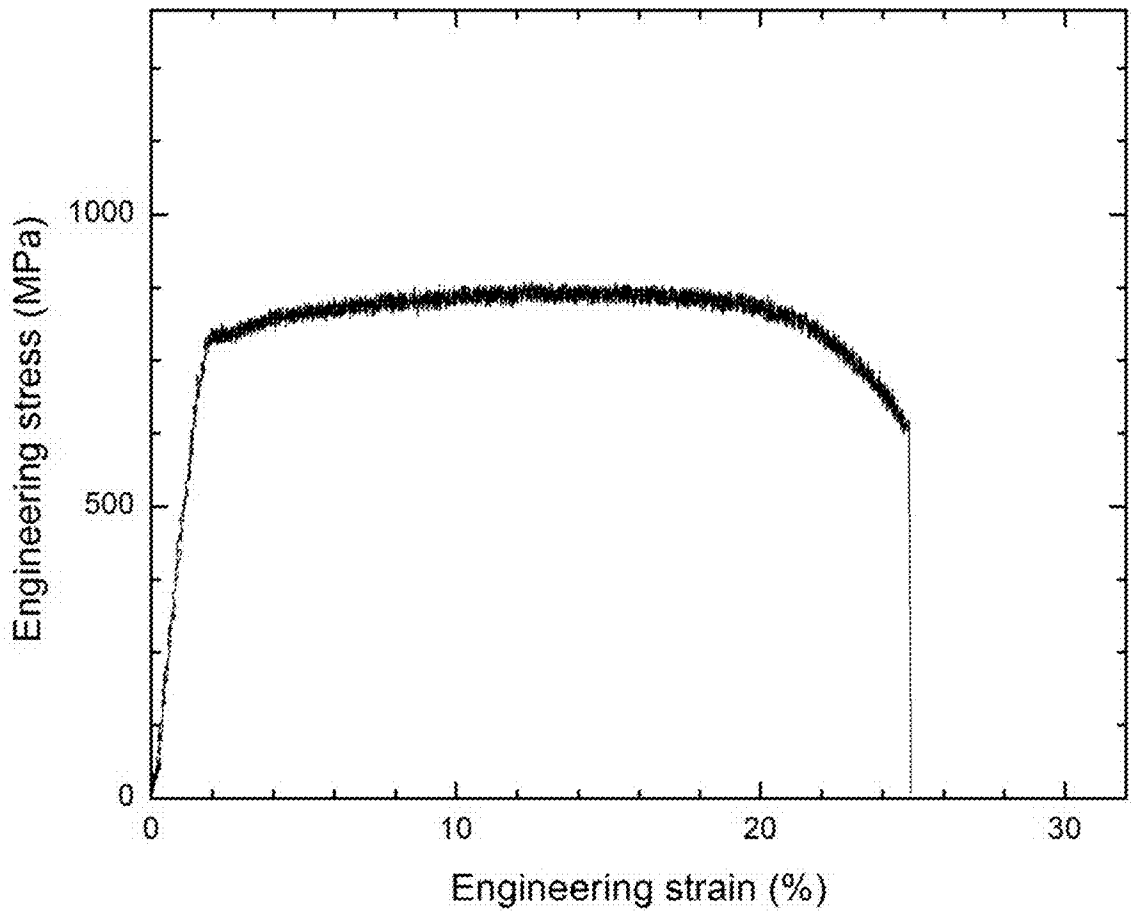
FIG. 7 shows a tensile curve of a titanium bar processed by ECAP at room temperature.

For comparison, the mechanical properties of a Ti bar with a diameter of 10 mm treated by ECAP at room temperature were tested. As shown in FIG. 7, the processed Ti bar provides engineering stress with a range only with 750-875 MPa, which is lower than that of the Ti bar processed at cryogenic temperature.

The bulk nanostructured titanium with grain sizes smaller than 100 nm prepared by the present invention is applicable in medical implant application. More specifically, they are applied in orthopedic and cardiovascular devices, dental substitutes, and maxillofacial surgery and vascular stents.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A method for preparing a bulk nanostructured pure titanium from a pure titanium plate comprising:

providing at least one roller;

injecting liquid nitrogen onto the pure titanium plate to cool down the pure titanium plate to a temperature between −125° C. and −50° C.; and rolling the cooled pure titanium plate by the at least one roller to form the bulk nanostructured pure titanium.

2. The method of claim 1, wherein the at least one roller includes two rollers respectively located on both sides of the pure titanium plate.

3. The method of claim 1, wherein the step of rolling has a rolling speed between 0.05 and 2 rad/min.

4. The method of claim 1, wherein the cooled pure titanium plate is rolled 15 to 30 times.

5. The method of claim 1, wherein the pure titanium plate has a thickness between 2 mm and 10 mm.

6. The method of claim 1, wherein the bulk nanostructured pure titanium comprises grain sizes of less than 100 nm.

7. The method of claim 1, wherein the liquid nitrogen is injected from at least one liquid nitrogen sprayer.

8. The method of claim 1, wherein the at least one liquid nitrogen sprayer includes two liquid nitrogen sprayers respectively located on both sides of one of the at least one roller.

* * * * *